United States Patent [19]

Sekiguchi et al.

[11] Patent Number: 4,795,063

[45] Date of Patent: Jan. 3, 1989

[54] FLUID DISCHARGING DEVICE

[75] Inventors: Tomozo Sekiguchi, Kawaguchi; Kazuya Noguchi, Tokyo, both of Japan

[73] Assignee: Pentel Kabushiki Kaisha, Tokyo, Japan

[21] Appl. No.: 935,302

[22] Filed: Nov. 26, 1986

[30] Foreign Application Priority Data

Nov. 29, 1985 [JP] Japan ..... 60-184182
Jan. 31, 1986 [JP] Japan ..... 61-12927
Feb. 28, 1986 [JP] Japan ..... 61-28331

[51] Int. Cl.[4] ..... B67D 5/00

[52] U.S. Cl. ..... 222/105; 222/205; 222/321; 222/385

[58] Field of Search ..... 222/92, 105, 107, 173, 222/205, 207, 212, 213, 214, 377, 385, 383, 384, 378, 380, 321, 372

[56] References Cited

U.S. PATENT DOCUMENTS 1,982,497 11/1934 Cotchett ..... 222/385
2,133,411 10/1938 Zohe ..... 222/105 X
3,406,909 10/1968 Pfeiffer ..... 222/321 X
3,451,597 6/1969 Watson et al. ..... 222/212 X
3,507,586 4/1970 Gronemeyer et al. ..... 222/321 X
4,098,434 7/1978 Uhlig ..... 222/105 X
4,457,455 7/1984 Meshberg ..... 222/383
4,691,849 9/1987 Tada ..... 222/383

*Primary Examiner*—Joseph J. Rolla
*Assistant Examiner*—Nils E. Pedersen
*Attorney, Agent, or Firm*—Wenderoth, Lind & Ponack

[57] ABSTRACT

A fluid discharging device has a cylinder having a first valve at one end of a suction chamber, and a cylindrical piston movably mounted in the cylinder. The piston has a second valve and a suction opening. A resilient element such as a coil spring is mounted between the cylinder and the piston so that the piston is generally biased against the cylinder. This valve mechanism is disposed in a collapsable container which contains a fluid. The cylinder is connected to an opening of the fluid container so that the first valve is exposed. The fluid discharging device can be disposed within a casing which has a refined appearance and includes an actuator for manually actuating the valve mechanism.

9 Claims, 4 Drawing Sheets

FLUID DISCHARGING DEVICE

BACKGROUND OF THE INVENTION

1. Field of the Invention

The present invention relates to a fluid discharging device or a fluid dispenser which can discharge a fluid such as cosmetic having a predetermined viscosity contained in a liquid chamber, and more particularly to a fluid discharging device or dispenser which permits a predetermined amount of a fluid in the device to be discharged with a relatively simple structure. The present invention provides a fluid discharging mechanism having a simple structure which can be adopted to various kinds of dispensing devices especially to, for example, cosmetics or cosmetic applicators such as foundation applicators, lip color applicators, cosmetic cream applicators and beauty wash applicators, pain applicators, flavoring material applicators and other applicators for fluids or liquids having a predetermined viscosity.

2. Description of the Related Art

A conventional fluid discharging device is shown in Japanese Utility Model Publication No. 42-13648 published Aug. 3, 1967. The known fluid discharging device has a flexible container containing therein a desired fluid for use, a suction chamber connected through a passage to an opening of the chamber, a one-way valve between the suction chamber and the passage, a discharge opening at the side of the suction chamber, a ball which is positioned at the discharge opening and is spring-biased toward the suction chamber by a spring, and a spring biased piston at a corner of the suction chamber. When the piston is pushed mannually against a resilient force of the spring, the one-way valve is closed by the fluid filled in the suction chamber and, at the same time, the ball is pushed to permit the fluid to be discharged out of the discharge opening. When the pressure exerted on the piston is released to permit the piston to be returned by a force of the spring, the discharge opening is closed by the ball and the one-way valve is opened by a negative pressure so that the flexible container shrinks or collapses to supply the liquid into the suction chamber.

In the known fluid discharging device described above, a reciprocal movement of the piston can push the fluid from the flexible container and discharge it out of the container, and this operation can be continued until substantially no fluid remains in the container. However, the known device has a relatively complex and expensive structure having a piston mechanism with a one-way valve and ball and thus the device is less productive. Furthermore the piston mechanism is disposed at the opening of the flexible container and its structure is restricted and it does not meet the requirements of a thin and small size structure. Thus, applications of the device are limited.

SUMMARY OF THE INVENTION

An object of the present invention is to provide an improved fluid discharging device without the disadvantages inherent in the conventional device.

Another object of the present invention is to provide a new fluid discharging device which permits a reliable discharge of a predetermined, suitable amount of fluid facilitated by a simple pressing manipulation.

A further object of the present invention is to provide a new fluid discharging mechanism having a simple structure which is less costly to produce and is applicable with high versatility and flexibility to various types and shapes of containers.

Briefly, a fluid discharging device or fluid dispenser according to the present invention has a cylinder having a first one-way valve at its one end and a suction chamber, and a cylindrical piston axially slidably disposed in the cylinder. The piston has a second one-way valve at its one end and a suction opening at a position distal to the second one-way valve. A resilient element, preferably a coil spring, is disposed between the cylinder and the piston so that the piston is generally biased against the cylinder to form a double-valve mechanism. This valve mechanism is disposed in a shrinkable or collapsible container, which contains a fluid and is made of a flexible material, in such a manner that the cylinder is connected at its circumference to an opening of the container so that the above-described first one-way valve is exposed at the opening of the shrinkable container. The piston contacts at its other end, that is, its bottom an inner surface of the container at the position opposite to the opening of the fluid container. In a preferred embodiment of the invention, the above-described fluid discharging mechanism can be disposed within a casing which has a refined appearance, and an actuation button is movably positioned at a predetermined location on the casing so that a pressure mannually exerted on the actuation button can be press the piston relative to the cylinder.

DETAILED DESCRIPTION OF THE PREFERRED EMBODIMENTS

Figure 1:
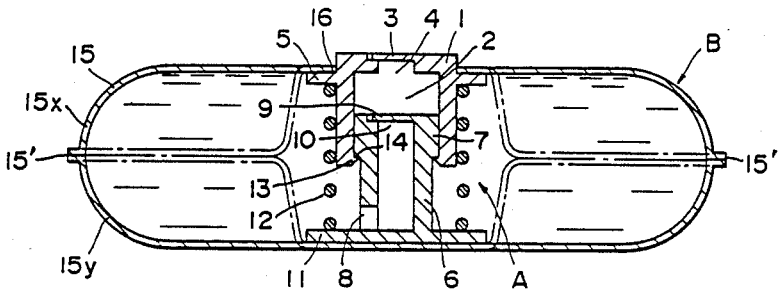
FIG. 1 is a sectional view of a fluid discharging device according to the first embodiment of the invention, showing a fundamental mechanism of the fluid discharging device.
Figure 2:
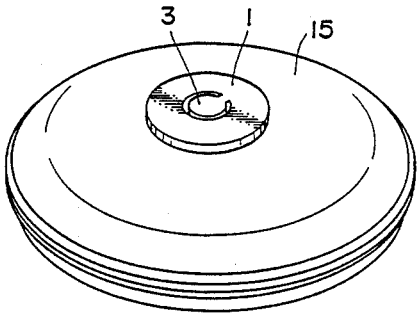
FIG. 2 is a perspective view of the fluid discharging device shown in FIG. 1, FIGS. 3 and 4 are illustrations of a valve mechanism employed in the device show in FIG. 1, showing an operation of the valve mechanism.

Referring to FIGS. 1 and 2 showing the first embodiment of the invention, a cylinder 1 has a suction chamber 2 therein and a first one-way valve 3, which is openable in one direction extending opposite the suction chamber 2, at a top end thereof. The valve 3 functions to open and close and upper opening of the cylinder 1 and it is generally closed when no load of pressure is exerted thereon. The first valve 3 is integral with the cylinder 1; it may be unitary with the cylinder or formed separatedly and then attached to the cylinder in a suitable manner. The cylinder 1 has an annular flange at its one end or upper end portion as illustrated. A cylindrical piston 6 which is axially slidably mounted within the cylinder has a suction opening 8 which is open to a passage in the piston, and a second one-way valve 9 at its top end. The suction opening 8 is formed at the lower end portion which is distal to the location of second one-way valve 9 which is openable toward the suction chamber 2 of the cylinder 1. The second valve 9 functions to open and close an upper end portion 10 of the piston 6 and is generally closed when no load or pressure is exerted thereon. The second valve 9 is integral with the cylindrical piston 6; it may be unitary with the piston or formed separately and then attached to the piston in a suitable manner. The piston 6 has a flange 11 at its lower end, and coil spring 12 is disposed between the flange 5 of cylinder 1 and the flange 11 of piston 6 so that the piston and cylinder are biased in opposite directions from each other. The movement of the piston relative to the cylinder is limited by the engagement between a rib 13 of the cylinder 1 and a shoulder 14 of the piston 6. Thus, a double one-way valve mechanism A is formed and positioned within a shrinkable fluid container 15 which contains therein one of a plurality of predetermined fluids or liquids which have various viscosities. The fluid container 15 is made of a deformable flexible material and has an opening 16 at its upper central portion. The fluid container 15 may be made of a desired synthetic resin film or metal film which is moistureproof, deformable and has a desired mechanical strength, depending upon solid state properties of the liquid to be contained therein. The double one-way valve mechanism A formed with the cylinder 1, piston 6, two one-way valves 3, 9 and the resilient member such as coil spring 12 is positioned in a stable manner in the flexible container 15 by known methods such as by adhering or welding the opening portion 16 of the container 15 to the flange 5 of the cylinder 1 so that the first one-way valve 3 is exposed out of the opening 16 and the flange 11 of the piston 6 contacts an inner bottom surface of the flexible container 15. If necessary, a ring (not shown) can be usd for connecting the cylinder 1 to the opening 16 of the container by adhering the ring to the opening of the container and then press-fitting the ring to an upper portion of the cylinder.

The assembly of the fluid discharging device shown in FIGS. 1 and 2 will be explained. First, a spiral spring 12 is mounted around the cylinder 1 and then the piston 6 is inserted from the bottom into the cylinder 1 so that a sliding portion 7 of the piston 6 is axially slidably positioned in the suction chamber 2. At this moment, a resistance is encountered when the sliding portion 7 rides over the rib 13 but this resistance is immediately overcome due to flexibility and deformation of the cylinder and, therefore, insertion of the piston 6 into the cylinder 1 is carried out without difficulty and trouble. If a tapered surface (not shown) is provided on the sliding portion 7 of the piston, the insertion will be facilitated. After the piston 6 is inserted into the cylinder 1, the thus assembled valve mechanism A is inserted into the fluid container from a small opened portion (not shown) which is left open after hermetical sealing the circumferential end portion 15' of the upper and lower halves 15*x*, 15*y* of the fluid container 15, and the upper end portion of the cylinder 1 is fitted to the central opening 16 of the fluid container 15. Then, the portion of the container 15 surrounding the opening 16 is fixed to the flange 5 of the cylinder by a suitable method, and a fluid such as cosmetic liquid, if the device is used as a cosmetic applicator, is placed into the fluid container 15 from the above-described small opened portion of the circumference 15' of the container, and then the opened portion is sealed to provide a hermetically sealed fluid discharging mechanism B.

Figure 3:
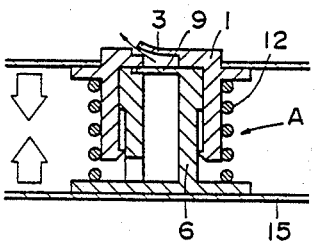
Figure 4:
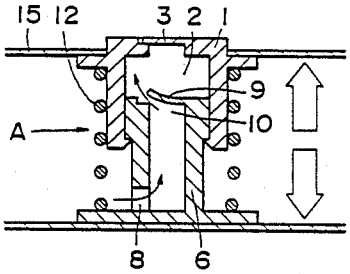

An operation of the fluid discharging device will be explained with reference to FIGS. 3 and 4. A pressure is exerted, by a finger tip operation, on an upper surface of the fluid container adjacent to the first valve 3 of the cylinder 1 and a bottom central portion of the fluid container so that the piston 6 is pushed in the suction chamber 2 of the cylinder 1 toward the first one-way valve 3 as shown in FIG. 3. During movement of the piston 6 toward the first one-way valve 3, the second one-way valve 9 is maintained closed and, accordingly, since the suction chamber 2 is filled with the predetermined fluid to be used, this fluid urges the first valve 3 upward to open the same and, when the suction chamber 2 is not filled with the fluid, the air in the chamber 2 urges the first valve 3 upward to open the same, so that the fluid is discharged out of the upper opening 4 of the cylinder 1. The quantity of the fluid discharged by a single operation depends upon the movement of the piston 6 within the suction chamber 2 and is limited to a maximum corresponding to the volume of the suction chamber. When the pressure exerted on the fluid container 15 is released, the piston 6 and the cylinder 1 are returned to their original positions by a spring-force of the coil spring 12, as illustrated in FIG. 4. During the return of the piston and cylinder, the suction chamber 2 is negatively pressurized and, accordingly, the first valve 3 is closed and the second valve 9 is opened by the fluid which flows from the opening 8 into the inner space of the piston 6, and the suction chamber 2 is filled with the fluid flowing through the opening 10 of the piston. Due to the flow of the fluid into the suction chamber 2, the fluid container 15 of flexible material collapses. A fully collapsed container is illustrated by phantom lines in FIG. 1.

As described above, a desired amount of the fluid contained in the fluid container 15 can be discharged by merely pressing the container to cause a relative movement of the piston to the cylinder.

The fluid discharging device described with reference to FIGS. 1 through 4 can have various types of casings which exhibit a refined appearance, which will be described hereinbelow.

Figure 5:
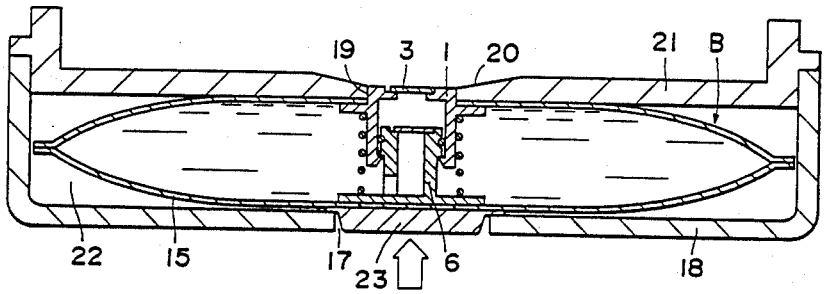
FIG. 5 is a sectional view of a fluid discharging device according to the second embodiment of the invention, showing a fluid discharging device which is substantially similar to that of FIG. 1 disposed within a casing having an actuation button.

FIG. 5 shows the second embodiment of the invention, in which the fluid discharging mechanism B shown in FIG. 1 is disposed in a space 22 confined by a casing 18 which has a dish-shaped cover 21. The casing 18 has a hole 17 at its bottom center, and an actuation button 21 fixed to a central bottom portion of the fluid container 15 is exposed from the hole 17 so that the outer surface of the actuation button 23 lies along the same plane as the surface of the bottom of the casing 18 as illustrated. The dish-shaped cover 21 has a central hole 19 for closely receiving the upper portion of the cylinder 1 so that the first valve 3 is exposed, and an inclined surface 20 extending around the central hole 19. In the fluid dispenser in the embodiment of FIG. 5, the actuation button 23 is pushed upward as illustrated by an arrow to urge the piston 6 toward the first valve 3 of the cylinder 1 so that the fluid in the container 15 is discharged through the double one-way valve mechanism to the inclined surface 20 of the cover 21. The other structural and operational features are substantially similar to those of the first embodiment of FIGS. 1 through 4.

Figure 6:
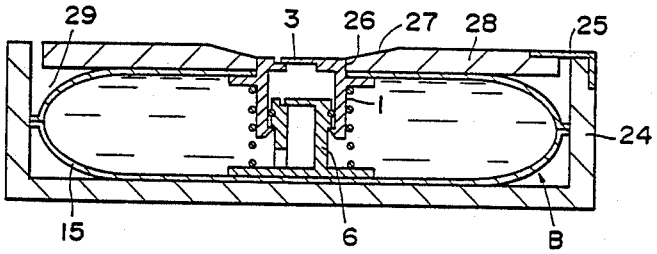
FIG. 6 is a sectional view of a fluid discharging device according to the third embodiment of the invention, showing a casing which has an actuation cover plate for moving a cylinder relative to a piston.
Figure 7:
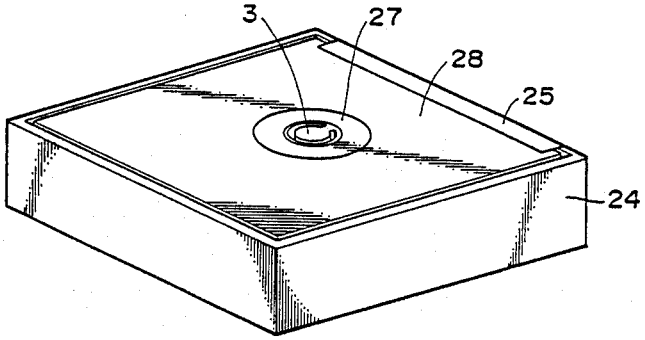
FIG. 7 is a perspective view of the fluid discharging device shown in FIG. 6.
Figure 8:
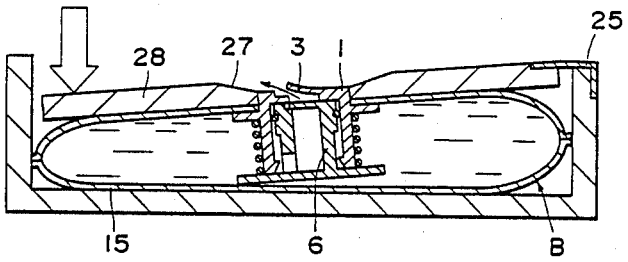
FIG. 8 is an illustration showing an operation of the fluid discharging device shown in FIGS. 6 and 7.

FIGS. 6, 7 and 8 show the third embodiment of the invention, showing a rectangular casing 24 and a rectangular cover 28. In this embodiment, the cover 28 is movably supported at one side thereof on the casing 24 by an L-shaped resilient connector 25 so that the cover 28 can be resiliently pivoted about the connector 25. The cover 28 has a central hole 26 to which an upper portion of the cylinder 1 is fixed, and an inclined surface 27 extending around the central hole 26. The fluid dispensing mechanism B is disposed in the space 29 formed by the casing 24 and the cover 28. A bottom of the piston 6 contacts the bottom portion of the fluid container 15, which contacts an inner surface of the bottom of the casing 24.

In the third embodiment of FIGS. 6–8, when pressure is exerted on the cover 28 at a portion distal to the resilient connector 25 so that the cover 28 is in an inclined position as illustrated in FIG. 8, the piston 6 is moved in the cylinder 1 toward the first valve 3. Thus, a liquid contained in the container 15 is discharged out of the valve 3 to the inclined surface 27. In this embodiment, the cylinder 1 is inclined along with the inclination of the cover 28, and at the same time the piston 6 is also inclined along with the cylinder without any trouble.

Figure 9:
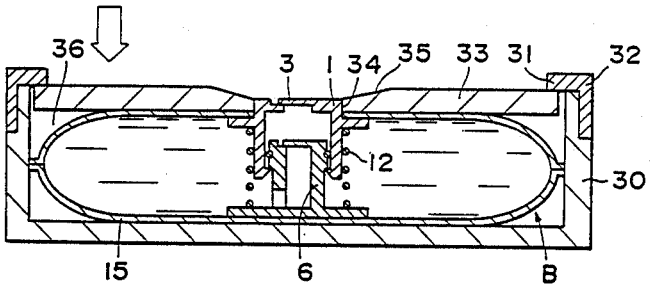
FIG. 9 is a sectional view of a fluid discharging device according to the fourth embodiment of the invention.
Figure 10:
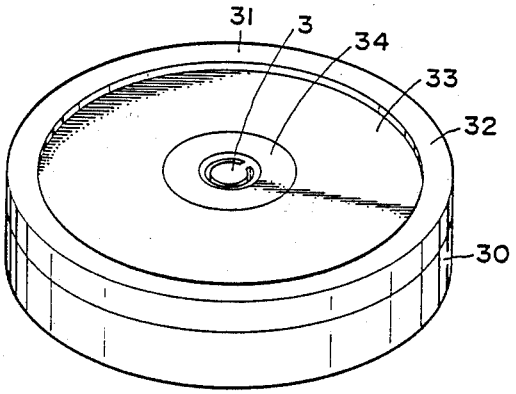
FIG. 10 is a perspective view of the fluid discharging device shown in FIG. 9.

FIGS. 9 and 10 show the fourth embodiment of the invention, in which a ring 32 having an inner projection 31 is mounted on a top of a circular casing 30, and a circular cover 33 is provided to form a space 36 for the fluid discharging mechanism B. The cover 33 has a central hole 34 in which the cylinder 1 is fixed and an inclined surface 34 extending around the hole 34. The cover 33 is generally biased upward by the coil spring 12 until it abuts against the inner projection 31 of the ring 32. In this embodiment, a pivotal fulcrum is not limited as is in the embodiment of FIGS. 6–8 and, accordingly, a force can be exerted at any place on the surface of the cover 33 without any positional restriction.

Figure 11:
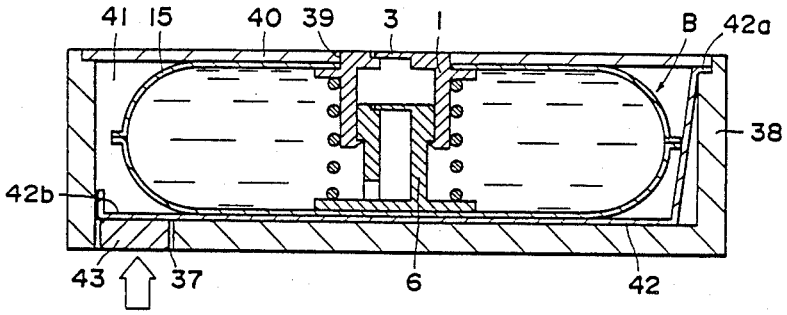
FIG. 11 is a sectional view of a fluid discharging device according to the fifth embodiment of the invention.

In FIG. 11 showing the fifth embodiment of the invention, a casing 38 has a hole 37 at a bottom thereof and a cover 40 having a central opening 39 is fixed to an upper end of the casing 38 to provide a space 41 for the fluid discharging mechanism B. An upper end portion of the cylinder 1 is fitted in the central opening 39 of the cover 40 with the first one-way valve 3 being exposed. An L-shaped resilient plate 42 is disposed between the fluid container 15 and the casing 38, and one end 42*a* of the plate 42 is fixed to an upper end of the casing 3 and the other end 42*b* is connected to an actuation button 43 which is movably positioned in the opening 37 of the casing 38.

When the actuation button 43 is pushed by a fingertip operation, the resilient plate 42 is pivoted about the fulcrum of its end 42*a*, which is connected to the upper end of the casing 38, to produce pressure acting on the fluid container 15 to thereby push the piston 6 into the cylinder 1. Thus, a fluid contained in the container 15 is discharged from the valve 3.

Figure 12:
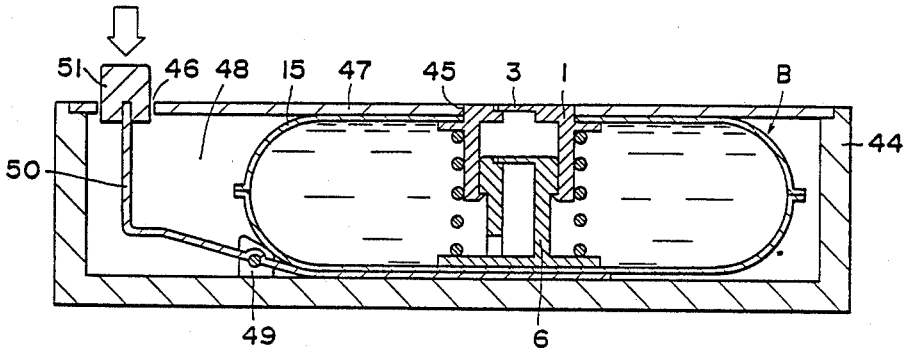
FIG. 12 is a sectional view of a fluid discharging device according to the sixth embodiment of the invention.

FIG. 12 shows the sixth embodiment of the invention in which a casing 44 and a cover 47 form a space 48 for the fluid discharging mechanism B. In this embodiment, the cover 44 has an opening 45 adjacent to a central portion thereof for hermetically holding an upper portion of the cylinder 1 with the first valve 3 exposed, and a hole 46 for receiving an actuation button 51. The button 51 is connected to a lever 50 which extends between the fluid container 15 of the discharging mechanism B and the bottom of casing 44. The lever 50 is pivotably supported about a fulcrum 49. Thus, when the actuation button 51 is pushed, the lever 50 is pivoted about the fulcrum 49 to produce pressure acting the fluid container 15 to thereby push the piston 6 into the cylinder 1. Thus, a fluid contained in the container 15 is discharged from the valve 3.

Figure 13:
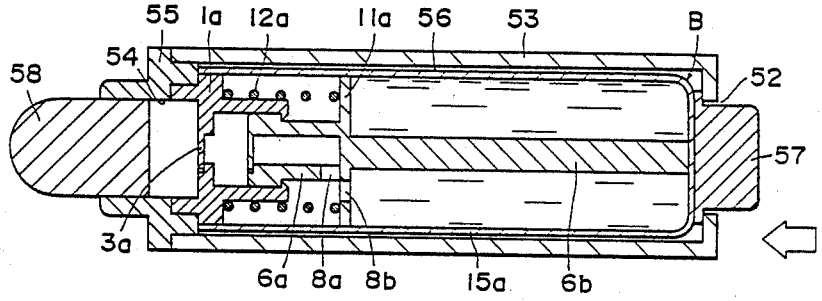
FIG. 13 is a sectional view of a fluid discharging device according to the seventh embodiment of the invention.

FIG. 13 shows a pen type fluid dispenser according to the seventh embodiment of the invention, in which an elongated cylindrical casing 53 has a hole 52 at one end or bottom to receive an actuation button 57 and a ring-shaped adaptor 55 at the other end for mounting a nib 58 at the opening 54 thereof for dispensing a fluid. The cylindrical casing has a space 56 which is substantially occupied by a fluid discharging mechanism B which is slightly different from those of the previous embodiments. In the embodiment of FIG. 13, a cylinder 1*a* is press-fitted to the adaptor 55 and a piston 6*a* the piston 6*a* has a suction hole 8*a*, a flange 11*a*, a hole 8*b* and an elongated support 6*b* which extends from a bottom center of the cylinder within an elongated fluid container 15*a*. The hole 8*b* of the flange 11*a* communicates with the chamber of the fluid container 15*a* and the suction hole 8*a*. The piston 6*a* is spring-biased toward the actuation button 56 by a coil spring 12*a* disposed between the cylinder and the piston so that the elongated support 6*b* contacts the actuation button 56 through a wall of the fluid container 15*a*. When the actuation button 57 is pushed, the piston 6*a* is pushed toward the one-way valve 3*a* of the cylinder so that a fluid contained in the container 15*a* is discharged from the valve 3*a* into the nib 58 made of, for example, a bundle of synthetic fibers.

Although the present invention has been described with reference to the preferred embodiments, many modifications and alterations can be made within the spirit of the invention.

What is claimed is:

1. A fluid discharging device comprising:

a collapsible fluid container comprised of flexible material for containing fluid, said container having an opening therein; and a double one-way valve mechanism mounted to said container within said opening for discharging a predetermined quantity of the fluid from said container, said double one-way valve mechanism comprising a cylinder in which a suction chamber is defined, a cylindrical piston slidably mounted to said cylinder, and a resilient member disposed between said cylinder and said piston for resiliently biasing said cylinder and said piston in respective opposite directions, said cylinder having one open end thereof in communication with the suction chamber and disposed at a location adjacent the outer peripheral surface of said container, and a first one-way valve comprising a resilient flap integral with the cylinder and extending over said one open end, said integral flap movable in a direction extending away from said suction chamber between a first position at which said open end is covered by said resilient flap and a second position at which said open end and said suction chamber in communication therewith are exposed to the environment outside said container, said resilient flap self-biased toward said first position whereby said open end is normally covered, said piston having a sliding portion extending within said cylinder for sliding therein, a suction opening extending between the interior of said container and said suction chamber, and a second one way valve located between said suction opening and said suction chamber for selectively placing the interior of said container in communication with said suction chamber via said suction opening, said second one-way valve comprising a second resilient flap integral with said sliding portion, said second resilient flap movable in a direction extending toward said suction chamber between a first position at which said second resilient flap closes said suction chamber to the interior of said container and a second position at which said second resilient flap places the interior of said container in open communication with said suction chamber.

2. A fluid discharging device as claimed in claim 1, and further comprising a casing, and a cover for covering said casing with a space established between said casing and said cover, said fluid container disposed in said space, and wherein said cover has an opening extending therethrough and through which said cylinder extends with said first one-way valve exposed, and said casing has a casing hole extending therethrough and an actuation button movably disposed in said casing hole, said actuation button operatively connected to said piston through said fluid container for moving said piston relate to said cylinder when manually actuated.

3. A fluid discharging device as claimed in claim 1, and further comprising a casing, and a cover for covering said casing with a space established between said casing and said cover, said fluid container disposed in said space, and wherein said cover has an opening extending therethrough and through which said cylinder extends wtih said first one-way valve exposed, and said cover is movably mounted to said casing and operatively connected to said cylinder for moving said cylinder relative to said piston when pressure is exerted on said cover.

4. A fluid discharging device as claimed in claim 1, and further comprising a casing, and a cover for covering said casing with a space established between said casing and said cover, said fluid container disposed in said space, and wherein said cover has an opening extending therethrough and through which said cylinder extends with said first one-way valve exposed, and said casing includes a ring extending over said cover for preventing said cover from being removed from said casing.

5. A fluid discharging device as claimed in claim 1, wherein the fluid discharge device also includes an actuation button and an actuation lever connected to said actuation button, said actuation lever extending between said fluid container and said casing.

6. A fluid discharging device as claimed in claim 13, wherein said casing has a casing hole extending therethrough, and said actuation button is disposed in said casing hole.

7. A fluid discharging device as claimed in claim 5, wherein said cover has a cover hole extending therethrough, and said actuation button is disposed in said cover hole.

8. A fluid discharging device as claimed in claim 1, and further comprising a tubular casing in which said fluid container is disposed, said tubular casing havng a casing hole defined at one end thereof and an adaptor at the other end thereof to which said cylinder is mounted, a fluid discharging rib projecting from said other end of said casing, an actuation button disposed in said casing hole and operatively connected to said fluid container at a location thereon comprising a portion of said container, and wherein said piston has an elongated member extending within said fluid container from said portion of said container.

9. A fluid discharging device as claimed in claim 1, wherein said piston has a shoulder defined on the outer surface thereof, and said cylinder has a rib extending therein, said rib engageable with said shoulder for limiting the relative movement of said piston and said cylinder in said respective opposite directions.

* * * * *